United States Patent [19]

Sheinberg et al.

[11] 4,420,155

[45] Dec. 13, 1983

[54] CONVERTIBLE BOWLING ALLEY

[76] Inventors: Zena Sheinberg; Alex Wortman, both of 526 Pauline Blvd., Ann Arbor, Mich. 48103

[21] Appl. No.: 350,323

[22] Filed: Feb. 19, 1982

Related U.S. Application Data

[62] Division of Ser. No. 108,033, Dec. 26, 1979, Pat. No. 4,330,122.

[51] Int. Cl.[3] ..... A63D 5/00
[52] U.S. Cl. ..... 273/51; 273/54 R
[58] Field of Search ..... 273/37, 39, 51, 54 R

[56] References Cited

U.S. PATENT DOCUMENTS

| | | | |
|---|---|---|---|
| 2,628,103 | 2/1953 | Parmer | 273/51 X |
| 3,401,933 | 9/1968 | Conklin et al. | 273/37 |
| 3,762,711 | 10/1973 | Cooper | 273/39 X |

*Primary Examiner*—Anton O. Oechsle
*Attorney, Agent, or Firm*—Hubbell, Cohen, Stiefel & Gross

[57] ABSTRACT

In an improved bowling alley resilient or non-resilient deflection means are removably disposed along both sides of the lane bed for preventing balls from dropping into the gutters of the bowling alley. Exemplary deflection means of the invention are tubes, springs, elastic bands removably disposable in the gutters and conveniently storable elsewhere when removed.

2 Claims, 23 Drawing Figures

FIG. 10
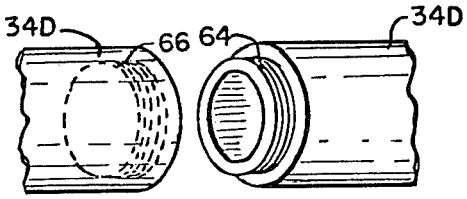
FIG. 12
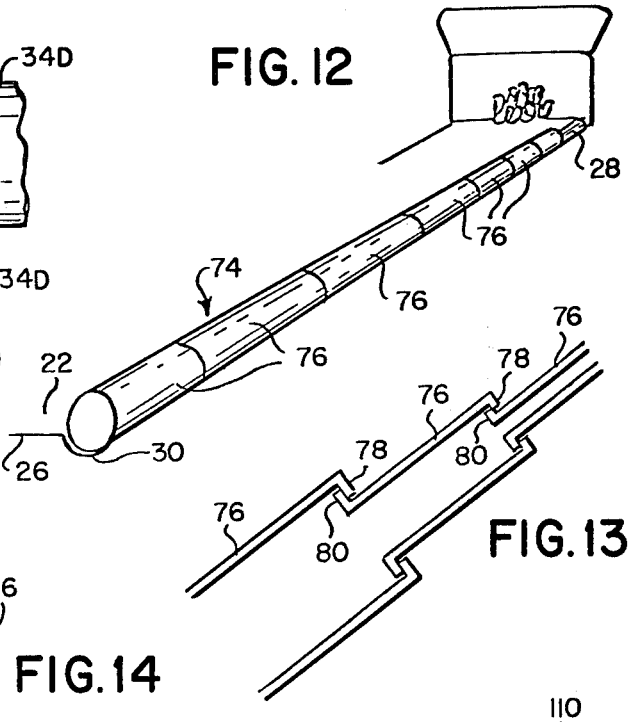
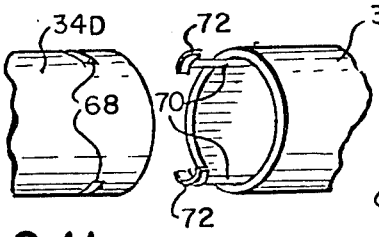
FIG. 11
FIG. 13
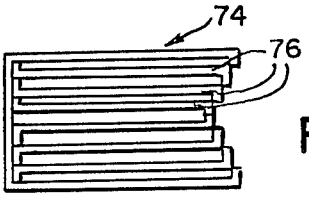
FIG. 14
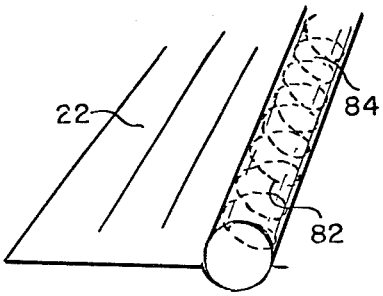
FIG. 15
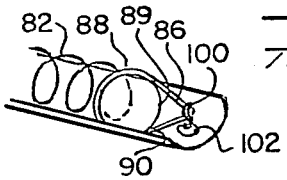
FIG. 16
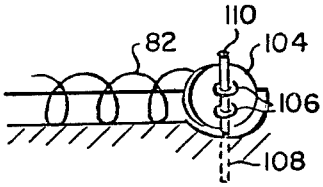
FIG. 17
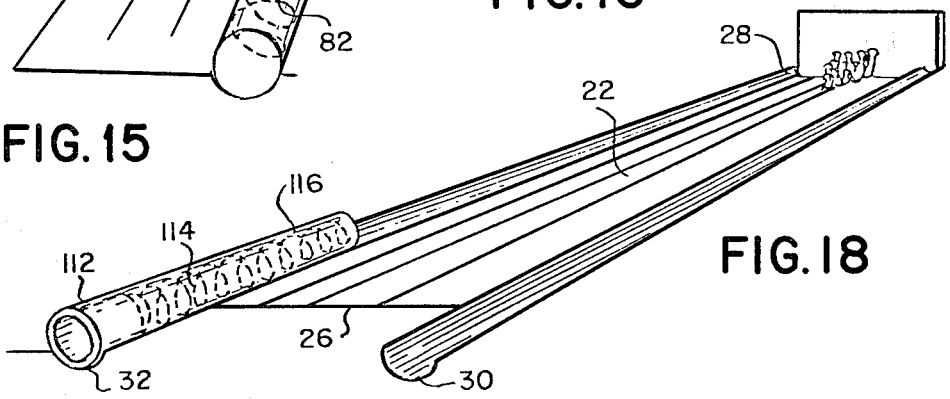
FIG. 18
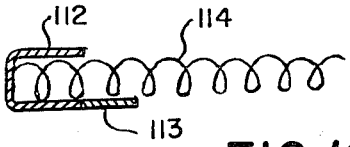
FIG. 19
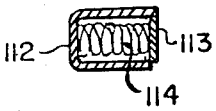
FIG. 20

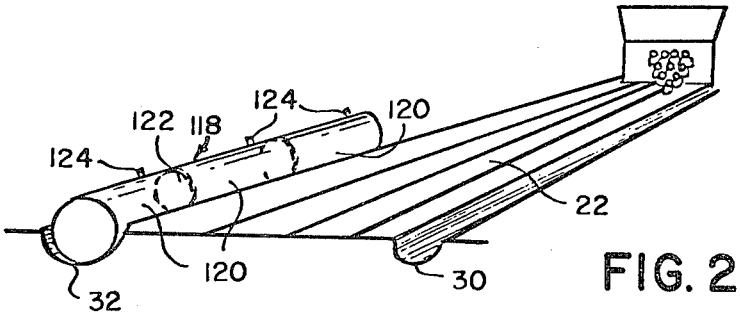
FIG. 21
FIG. 22
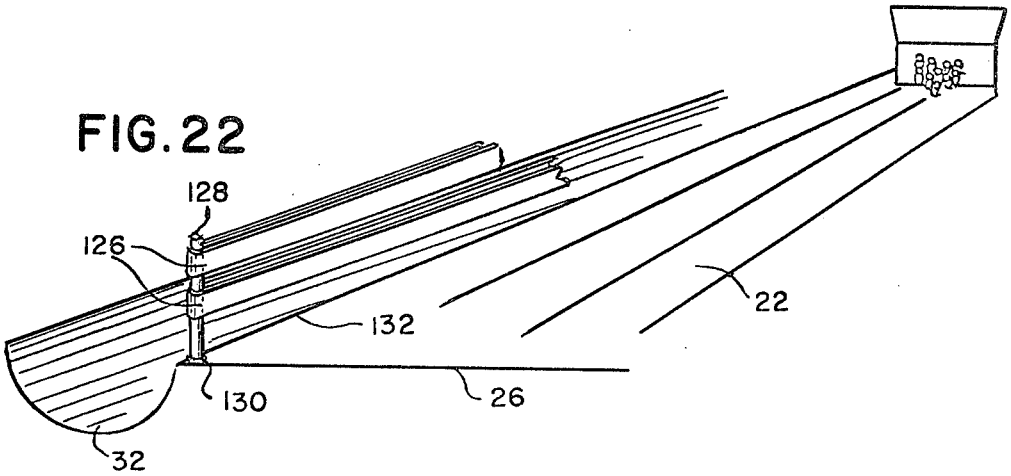
FIG. 23
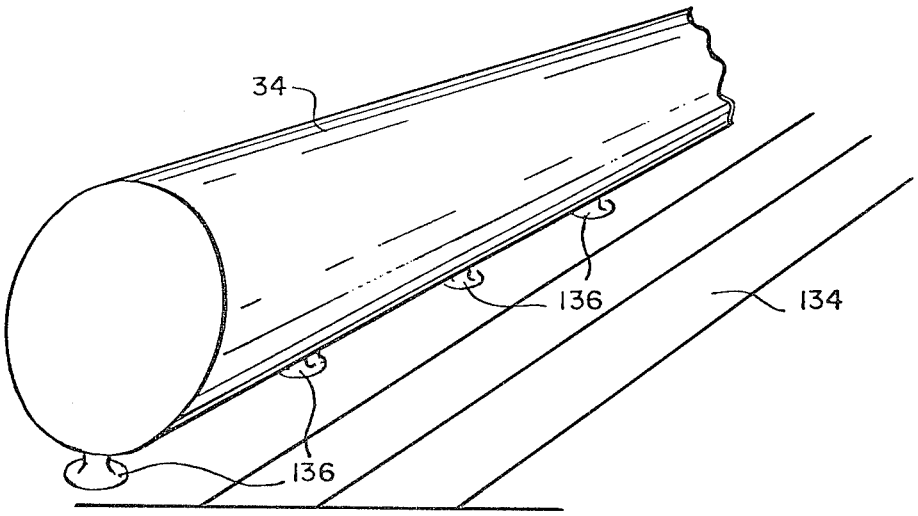

CONVERTIBLE BOWLING ALLEY

This is a division of application Ser. No. 108,033, filed Dec. 26, 1979, now U.S. Pat. No. 4,330,122.

BACKGROUND OF THE INVENTION

1. Field of the Invention

The present invention relates to bowling alleys and in particular to bowling alleys which may be used by developmentally disabled persons to enhance their sense of achievement. In particular, this invention relates to bowling alleys having means removably disposed in the alley gutters to provide deflection surfaces against which misdirected balls will bounce and remain on the lane to ultimately knock down pins.

Most often, developmentally and physically disabled persons, the "handicapped", are confronted with failure. In various forms of educational methodologies and treatments they are confronted with challenges over which they succeed slowly, if at all. What may seem to the able bodied person to be the most routine of tasks can prove to be a source of great frustration for the handicapped.

The continual failure which disabled persons often experience can be demoralizing. This feeling can lead to the handicapped person giving up his attempts at old tasks as well as new ones. This failure leads to low self-esteen and self-worth which consequently can cause the handicapped person, at any age, to diminish whatever self-help skills and feelings of independence he or she has. The result is an increasing demand on dependence on those around them: the family and the community.

The importance of providing enjoyable, enriching successful activities to increase effective skills should not be underplayed. In the light of Public Law 94-142, The Education of All Handicapped Children's Act, it was mandated that appropriate educational plans must be written by the school and approved of by the parent or guardian for each handicapped individual ages three through 21. (Different states have different ranges.) The implications of this law are extensive. Implementation of specific goals for each impaired person reach into the psychomotor, cognitive and affective domains. The present invention increases the handicapped person's chances of attaining particular goals through a simple modification of an existing bowling alley. The product could also be purchased, in portable kit form, by a school or institution thereby costing the bowling establishment nothing at all. Furthermore, the deflection device's easy usage encourages the handicapped, as well as the aged, to move into the community mainstream by providing them with a leisure time activity already available to persons without handicap.

Specifically, the present invention is directed to the game of bowling. Bowling is an especially desirable activity which provides excitement as well as motoric growth and socialization that can be engaged in during inclement weather. However, bowling, even for those without handicaps, is not a very easy task. For the handicapped, what usually happens is that they are unable to direct the bowling ball in a straight enough path to actually knock down any pins. It is not uncommon for a handicapped person attempting to bowl to totally fail, i.e., to roll 20 "gutter balls" in one game. Such an experience is frustrating. When constant failure is repeated game after game, week after week, it weakens the already frail self-esteem. To avoid this discouraging and sometimes depressing result, the present invention is directed to means which, when combined with a standard bowling alley, converts the bowling alley into a carom bowling alley wherein the ball, if misdirected towards a gutter, bounces off the means and remains on the alley until it finally hits pins. The knocking down of the pins is tantamount to success. It is a more exciting and elating experience than usual for the handicapped person playing the game. There can be a sense of joy and an understanding of a cause and effect relationship. The handicapped person can achieve a positive result, he can be successful.

2. Description of the Prior Art

U.S. Pat. No. 3,401,933 discloses a convertible bowling lane suitable for ordinary bowling and carom bowling. The lane includes movable means which when retracted define the bottoms of the lane gutters along both sides of each lane and when extended provide upstanding ball deflection device. The movable means is operated through a complex drive by a reversible motor energized by a control system. The disclosed system calls for considerable additional expense in new bowling alleys to be so built, as well as for extensive remodelling at great expense for alleys already in existence. This has served as a deterrant to its use. Thus, U.S. Pat. No. 3,401,833 has had little significant effect on the opportunity for the handicapped to carom bowl.

Obvious disadvantages of the prior system, i.e., a high purchase price to be borne by the owner of the bowling alley, and a potentially high susceptibility to failures due to the comlexity of the system are overcome by employing the removable deflection means of the present invention. The present invention's removable, as opposed to the merely movable, deflection means of the prior art means that inserts can be removably placed into the gutters of any conventional bowling alley for use by handicapped bowlers and then actually removed therefrom for storage elsewhere so that the lane may be played in the conventional manner.

SUMMARY OF THE INVENTION

The present invention provides simple and relatively inexpensive deflection means that are removably disposable in a standard gutter of a bowling alley for deflecting bowling balls rolled down the lane back onto the lane when they otherwise would be caught by and kept in the gutters and thus be prevented from striking the pins. The various deflection means of the present invention are all removably disposable in the gutter, are conveniently storable elsewhere when removed, and, in some embodiments, nest or fit in the gutters abutting the bowling lane on both sides thereof. Alternatively, they may be elastic bands extending along both sides of the lane. Bowling balls, uncontrollably thrown, especially by physically or mentally handicapped children and adults which otherwise would leave the bowling lane are thus deflected back onto the lane and kept in the game for striking the pins.

BRIEF DESCRIPTION OF THE DRAWINGS

FIGS. 3–11 are fragmentary perspective views of various tubular forms of deflection means useable in the present invention;

FIG. 12 is a fragmentary perspective view of a deflection means in the form of a telescopic tube;

FIG. 13 is a fragmentary longitudinal sectional view of the deflection means of FIG. 11 in extended condition for use;

FIG. 14 is a longitudinal sectional view of the deflection means of FIG. 12 in contracted position for storage;

FIG. 15 is a fragmentary perspective view of another deflection means, this in the form of a covered coil spring;

FIG. 16 is a fragmentary perspective view of the deflection means of FIG. 15 showing one form of fastening means;

FIG. 17 is a fragmentary perspective view of the deflection means of FIG. 15 showing another form of fastening means;

FIG. 18 is a fragmentary perspective view of another form of deflection means with storage device;

FIG. 19 is a view partly in elevation and partly in longitudinal section of the deflection means of FIG. 18 in extended position ready for use;

FIG. 20 is a view similar to FIG. 19 but of a box and spring showing said deflection means of FIG. 18 in contracted position ready for storage;

FIG. 21 is a fragmentary perspective view of another form of deflection means in the form of elastic bands; and FIG. 23 is a fragmentary view of removable bumpers provided with means for securing to a flat floor to convert a section of the floor to a carom bowling alley.

DETAILED DESCRIPTION OF THE DRAWINGS

Before describing the drawings in detail, it should be understood that many embodiments of the present invention are possible, with the drawings merely illustrating exemplary embodiments of removable deflection means. The presently preferred removably disposable deflection means, sometimes hereinafter referred to as "inserts", of the present invention may be briefly described as employing resilient or non-resilient deflection means removably disposable along both sides of the lane for preventing balls from dropping into the gutters of a bowling alley.

Figure 1:
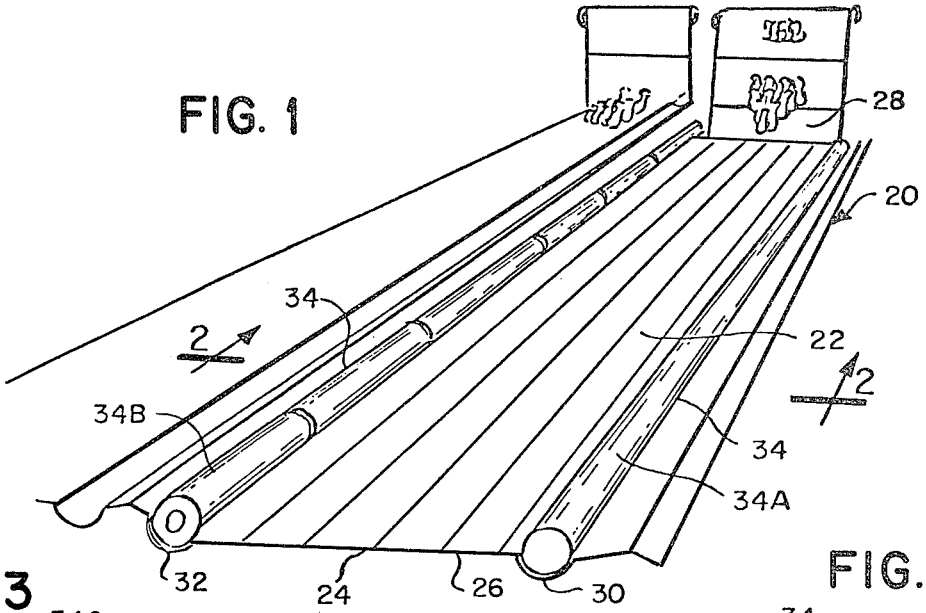
FIG. 1 is a perspective view of a bowling alley illustrating one form of deflection means of the present invention.
Figure 2:
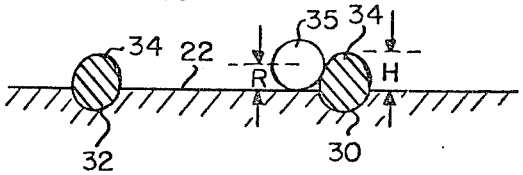
FIG. 2 is a sectional view taken along the line 2—2 of FIG. 1.

Referring now to FIGS. 1 and 2 in detail, a conventional bowling alley 20 is shown, having a conventional bowling lane or bed 22, an approach 24, a foul line 26 on one end of the lane and a pin deck 28 on the other end thereof. Abutting the lane 22 on both sides are standard or conventional gutters 30 and 32 for catching improperly directed bowling balls leaving the lane 22 and for guiding them to conventional means adjacent the pin deck for returning the balls to the player. Once a bowling ball has left the lane 22 and is caught by a gutter 30 or 32, the ball is guided past the pins without striking them, resulting in no score for the player. This makes the game unattractive and frustrating for the physically and mentally handicapped who find it extraordinarily difficult to project the ball along a path that will avoid the gutters.

In accordance with the embodiment shown in FIGS. 1 and 2, removably disposed within the gutters 30 and 32 are deflection means 34. For brevity of description, the two deflection means are somewhat different and represent two modifications of the same basic structure which may be termed "a bolster-like structure". That is to say, in the right-hand gutter 30, the deflection means 34A comprises a cylindrical body preferably (but not necessarily) having radius about the same as the radius of the gutter 30 and extending as one unit for the entire length of the gutter from the foul line 24 to the pin deck 28. The deflection means 34A may be made of a stiff, foam-like material such as polyurethane foam or a stiff foam rubber extruded in one piece or it may be some chunk form of foam-like material or other type of stuffing such as down, feathers, cotton or the like stuffed into a surrounding and enveloping cylindrical fabric sheet, made of cloth or plastic or the like. The structure illustrated in the left-hand gutter 32 of the lane 20 of FIG. 1 and designated by the reference character 34B is essentially identical in structure to the deflection means 34A save that it is made up of a multiplicity of short bolster sections or segments which lie end to end, preferably in abutting relationship, within the gutter 32. This segmented deflection means 34B facilitates removal and storage when it is desired to restore the lane 20 to use as a conventional bowling alley. Excepting for the fact that the left lane deflection means 34B is segmented, the structure may be any of those structures hereinbefore described with respect to deflection means 34A.

In lieu of the relatively solid foam or stuffed bolster-like structures 34A and 34B of FIGS. 1 and 2, the deflection means 34 may be tubular in configuration. In a tubular configuration, the deflection means may be unitary and extend the full length of a gutter 30 or 32 or it may be segmented into a series of short tubes which are placed in end-to-end relationship, preferably abutting in a mode similar to that of deflection means 34B in FIG. 1.

Figure 3:
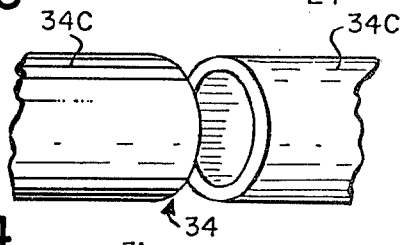

A fragment of two such segmented tubes is shown in FIG. 3. Preferably, the tubular deflection means has a radius substantially equal to the radius of the gutters, although so long as the diameter permits it to extend above the lane bed by an inch or two, it will satisfactorily deflect misdirected bowling balls. Such tubes may be made of any suitable material that will withstand the impact of a bowling ball. Among materials which would be satisfactory are a variety of the plastic materials, preferably extruded, possibly fiber reinforced, as well as cardboard, aluminum or the like.

Figure 4:
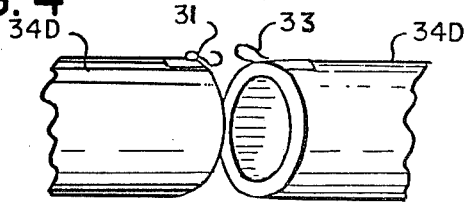

FIG. 4 shows a fragmentary view of the ends of two inserts 34D to be interconnected by way of hooks 30, which are provided at one end of each tube 34D. To effect a connection, hook 30 on one insert 34D is engaged with a loop 32 on the confronting end of the adjacent tube 34D. Thus, each hook 30 lies adjacent to and engages each adjacent loop 32 to form a continuous removable and storable tubular deflection means.

Figure 5:
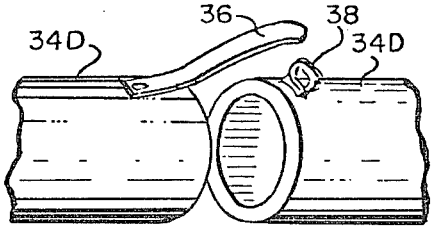

FIG. 5 illustrates another detachable means for releasably connecting adjacent inserts 34D. These connecting means comprise an elastically flexible tongue 36 and an inverted U-shaped buckle 38 on confronting ends of adjacent inserts 34D. Tongue 36 may be elastically deformed and slipped through buckle 38 and then released to secure adjacent insert segments 34D to one another.

Figure 6:
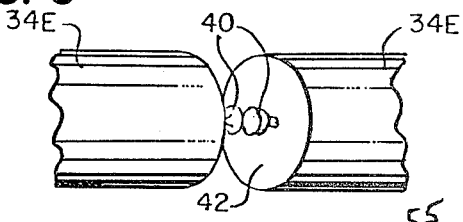

In FIG. 6 there is shown still another releasable connecting means for adjacent inserts 34D, namely suction cups 40. In FIG. 6, the suction cups are shown in combination with inflatable tubes, although stuffed bolsters having substantially flat end portions 42 may be used therewith. One end of an inflated tube or bolster is pressed against the confronting end of the second tube or bolster to join the suction cups and thus keep them in connected condition by the vacuum between the cups and the atmospheric pressure reacting against it.

Figure 7:
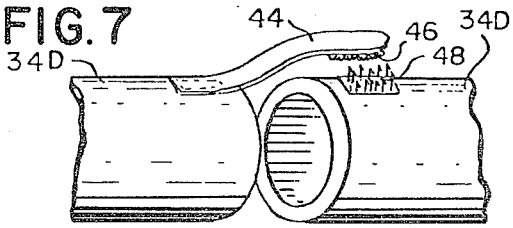
Figure 8:
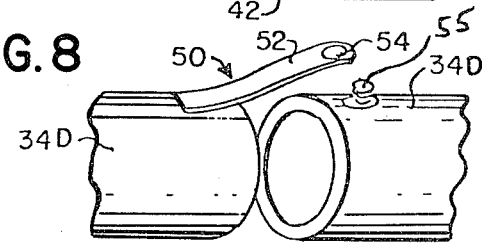

FIG. 7 shows a fragmentary perspective view of the ends of two tubes 34D in which the connecting means is Velcro®, i.e., a flexible tongue 44, one end of which is connected to one end of each tube 34D, is provided with a Velcro® layer that is a layer of plastic hooks 46 and a similar layer of Velcro® fastened to the other end of each tube 34. When these layers are brought into engagement they hold fast thus providing an effective connection between the tubes. Clearly, the same connecting means may be used with inserts which are constructed like bolsters, FIG. 1, or with inflatable tubes, FIG. 6. FIG. 8 shows another detachable connecting means for two adjacent inserts 34D. In FIG. 8, a snapper 50 comprising a flexible tongue 52 having at its free end a female snap fastening member 54 may cooperate with a male snap fastener element on the other end of the adjacent inserts 34D. When the tongue 52 is depressed, the snap fastener elements 52 and 54 releasably engage to hold the inserts 34D together.

Figure 9:
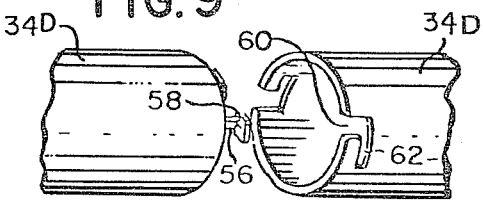

FIG. 9 shows fragments of two sections of gutter inserts with still another releasable connecting means. This means is in the form of a bayonet joint in which two feet 56 mounted at one end of each tube section or insert 34D are provided with projections 58 extending outwardly from and perpendicular to the feet 56. The confronting end of the adjacent tube section or insert is provided with an axial slot 60 having a circumferential portion 62 extending perpendicular thereto. When the tube sections 34 are brought together, projection 58 is placed into slot 60 and when one tube section 34D is turned relative to the other, the projection will slide into portion 62 to releasably hold the confronting tubes.

FIG. 10 shows yet another releasable connecting means for two adjacent tube sections or gutter inserts. One end portion of one tube section 34D is provided with an external thread 64 rotatably engageable with the internal thread 66 provided in the confronting end of the adjacent tube. By simply turning one or both adjacent tubes a releasable connection between two tubes is obtained.

FIG. 11 shows still a further detachable connecting means for two adjacent inserts or tube sections 34D. As shown, one tube section 34D is provided with two diametrically opposed slots 68 near one end thereof. The confronting end of the adjacent insert 34D is provided with two elastic tongues 70 having outwardly extending projections 72 dimensioned to fit into the slots 68. Connection is made by pressing the tongues 70 together, inverting them into the end of the confronting tube 34D, and then putting the tubes together until the projections 72 align with slots 68. The resiliency of the tongues 70 urges the projections 72 into the slots 68 thereby releasably holding the tube sections together.

Various other embodiments of the deflecting means 34 for the present invention are shown in FIGS. 12–23. FIGS. 12, 13 and 14 show a deflecting means in the form of a telescopic tube 74 disposed in gutter 30. The tube 74 comprises several tubular members 76 of successively smaller diameter to permit telescoping, the length of which when fully extended equals substantially the length between foul line 26 and pin deck 28. As shown in FIG. 13, each tubular member 76 is provided with an inwardly extending flange 78 on one end thereof, while the other end is provided with an outwardly extending flange 80, which when the tube 74 is fully extended engages with flange 78, thus operating as a stop for preventing the separation of the undivided members 76. Conveniently, the tube 74 may be contracted, as shown in FIG. 14 to a length equal to the length of one member 76 and may be removed from the gutter and stored in that condition. When required for use, the collapsed tube 74 is placed in the gutter at or around the foul line 26 and is then extended up to approximately the pin deck 28 as is diagrammatically shown in FIG. 12.

FIGS. 15, 16 and 17 show a deflection means comprising a coil spring 82 which is preferably covered by any suitable flaccid material 84, like plastic or fabric sheeting, to prevent the bowling ball from wedging between adjacent turns of the coil and thus losing all of its kinetic energy or at least a substantial part thereof, as would prevent the ball from ultimately knocking down many pins. The spring 82 is self-biased to a contracted position. To use it as a deflection means, it must be stretched the length of the lane and then secured by suitable holding means at both ends in order to maintain it in its extended position where it serves to deflect balls. When released from its holding means, it will contract by itself to a manageable length and the contracted tube may thereafter be removed from the gutter and conveniently stored. If adjacent turns of the coil 82 in expanded condition are close enough so that a bowling ball cannot be entrapped therebetween, flaccid covering 84 may be dispensed with.

The holding means for spring 82 are preferably of a type that when the spring 82 and the holding means are removed, no projections or obstacles remain in the gutters and that the path of a ball caught in the gutters during the conventional bowling game remains unobstructed. Exemplary securing means are illustrated in FIGS. 16 and 17. FIG. 16 shows a belt 86, one end of which is mounted to the top 88 of the end turn 89 of coil 82 while the other end is mounted to the bottom 90 of the turn 89. The belt 86 runs through a loop 100 which is connected to a suction cup 102. The suction cup 102 may be placed into the gutter at or around the area of the pin deck and pressed thereagainst to thus maintain the spring 82 fixed. The opposite end may be similarly fixed near the foul line to hold spring 82 in extended condition.

Another form of securing means is shown in FIG. 17 wherein both ends of coil 82 are provided with an end plate 104 each having two loops 106. The gutters 30, 32 are provided with vertical holes 108 at or about the areas of foul line 26 and pin deck 28. To secure the two ends of the spring a rod 110 is inserted through loops 106 in each base plate and into the holes 108 in the gutter thus releasably maintaining and holding the ends of spring 82 in extended condition.

Another suitable deflection means is shown in FIGS. 18 to 20. This means is also a coil spring 114. Coil spring 114 may be covered with a suitable flaccid or material 116 as previously described in the FIG. 15 embodiment, although, as was true with that earlier embodiment, it is optional. As opposed to spring 82 in FIG. 15, spring 114 is normally self-biased to an extended condition and need not be secured in its normally extended condition during use. When retracted, it may be stored in a box 112. Preferably box 112 has a lid 113 which, when closed, holds spring 114 inside the container as illustrated in FIG. 20. The box may be cylindrical and may be placed into the gutter 30 or 32 around the area of the foul line 26. Then lid 113 is opened to release the spring 114 which extends substantially along the entire length of the bowling bed 22 to define the removable deflection means for carom bowling. After the game, to restore the alley for regular use, the spring 114 is compressed into the box 112 for storage, the box is then closed and then removed from the bowling alley gutter.

Referring now to FIG. 21, deflection means 34 may comprise one or more inflatable tubes 12. If more than one, they may be separate inflatable bolsters disposed end-to-end in the gutters, or part of a unitary structure separated by internal walls 122. Air nozzles 124 are provided for inflating and deflating each tube or tube section. The tube 118, when placed in the gutters 30 and 32 substantially fills and extends above the same for providing a satisfactory deflection means for misdirected balls. The tube 118 also extends in longitudinal direction substantially along the entire length of bowling bed 22. After its use the tube may be deflated, removed from the gutters, folded and stored at a convenient location.

Alternatively to an inflatable tube, one or more bolster-like pillows may be used, filled with any suitable resilient or non-resilient material as for example, polyurethane foam, foam rubber or the like. The bolsters are placed into the gutters in end-to-end relation, secured to each other in any of the manners described above and after the carom bowling game is over, are easily removable therefrom to restore the alley to regular use.

A fragmentary perspective view of another embodiment is shown in FIG. 22 in which at least one elastic band 126, preferably two or more, is attached at both ends to a pin 128 which is removably disposable in an opening 130 located in the corner formed by the foul line 26 and by the contact line 132 of lane 22 and gutter 32. The other end is secured in the same manner at the distant end of the bowling lane. The elastic band must be of sufficient width and sufficiently tensioned to deflect misdirected bowling balls back onto the lane bed 22.

Depending on the size of the deflecting means, one or more inserts are placed in both gutters abutting every conventional bowling lane or bed. The inserts extend substantially from the foul line to the pin deck, and they may be either a one-piece structure, or a plurality of interconnected single inserts. Although a circular cross-section is preferred, other shapes may be used. Vertically, the deflection means extend well above the bowling lane, whereby any misdirected bowling balls are deflected back onto the lane and finally strike the pins and at the same time are also prevented from jumping onto an adjacent bowling lane. Thereby, particularly the physically and mentally handicapped are able to score points and thus derive pleasure and gain self-confidence and receive psychological impetus. Particularly advantageous is that the inserts are easily removable from the gutters and may be manufactured in a size which also allows convenient storage thereof.

All of the deflection means above-described have been described in combination with a conventional bowling alley in which, save for the FIG. 22 embodiment, they are releasably disposed in the gutters. However, any of these deflection means may be removably connected to a flat floor 134 as by suction cups 136 or the like in spaced apart parallel relationship to define a carom bowling alley according to the present invention on any suitable flat floor as may be found, for example in a school, rehabilitation center or gym hall. This is illustrated with one exemplary deflection means in FIG. 23. In such an embodiment the cross-section may be non-circular, e.g., square, if desired.

Variations and modifications can, of course, be made without departing from the spirit and scope of the invention.

Having thus described my invention, what I desire to secure by Letters Patent and hereby claim is:

1. An improved bowling alley of the type comprising a bowling lane bed including an approach and a foul line at one end and a pin deck at the other end thereof and a pair of elongated gutters parallel to and abutting each side of said bowling lane bed, wherein the improvement comprises deflection means removably disposed longitudinally along both sides of said lane bed and outside of said gutters for deflecting a bowling ball rolled down said alley to thereby prevent said ball from falling into said gutters, said deflection means extending substantially along each side of said lane bed between said foul line and said pin deck, and upright pin support means removably disposable at its lower end in respective openings located in the corners formed by the said foul line and the contact lines of said lane bed and said gutter, and the corners formed at the distant end of said lane bed near said pin deck and at the contact line of said lane bed and said gutter, said deflection means being removably supported vertically above said lane bed by said upright pin support means whereby said bowling alley can serve as a conventional alley when said deflection means and said upright pin support means are removed and can serve as a carom bowling alley when said deflection means are supported in place.

2. A bowling alley according to claim 1 wherein said deflection means comprise at least one elastic band extending along each side of lane bed, said elastic bands being stretched between and removably held by said upright in support means at the corners of said foul line and said pin deck.

* * * * *